US006775886B2

(12) United States Patent
Ogle, II

(10) Patent No.: US 6,775,886 B2
(45) Date of Patent: Aug. 17, 2004

(54) URN FOR ASHES

(75) Inventor: George B. Ogle, II, Capistrano Beach, CA (US)

(73) Assignee: Angel Ashes, LLC, Newport Beach, CA (US)

( * ) Notice: Subject to any disclaimer, the term of this patent is extended or adjusted under 35 U.S.C. 154(b) by 0 days.

(21) Appl. No.: 10/230,725

(22) Filed: Aug. 29, 2002

(65) Prior Publication Data

US 2004/0040128 A1 Mar. 4, 2004

(51) Int. Cl.[7] ..... A61G 17/00
(52) U.S. Cl. ..... 27/1
(58) Field of Search ..... 27/1; D99/5

(56) References Cited

U.S. PATENT DOCUMENTS

| | | | | | |
|---|---|---|---|---|---|
| 1,558,278 | A | | 10/1925 | Phillips | |
| 1,660,085 | A | | 2/1928 | Nassau | |
| 4,324,026 | A | * | 4/1982 | Craft | 27/1 |
| D268,623 | S | | 4/1983 | Dercks et al. | |
| 4,521,999 | A | * | 6/1985 | Flanagan | 52/103 |
| 4,648,162 | A | | 3/1987 | Daino | |
| D304,641 | S | | 11/1989 | Bourassa | |
| D312,058 | S | | 11/1990 | Vermillion | |
| 5,016,330 | A | | 5/1991 | Botsch | |
| D327,765 | S | | 7/1992 | Roberts et al. | |
| D333,448 | S | | 2/1993 | Bohn | |
| 5,230,127 | A | | 7/1993 | Zukowski et al. | |
| D341,466 | S | | 11/1993 | Allen | |
| D341,467 | S | | 11/1993 | Allen | |
| D344,390 | S | | 2/1994 | May et al. | |
| D344,391 | S | | 2/1994 | May et al. | |
| D344,839 | S | | 3/1994 | May et al. | |
| D344,840 | S | | 3/1994 | May et al. | |
| D345,848 | S | | 4/1994 | May et al. | |
| D345,849 | S | | 4/1994 | Parker | |
| D350,010 | S | | 8/1994 | May et al. | |
| 5,349,727 | A | * | 9/1994 | Niebergall | 27/1 |
| 5,379,499 | A | | 1/1995 | Jackson | |
| D356,421 | S | | 3/1995 | Parker | |
| D356,422 | S | | 3/1995 | Parker | |
| D359,831 | S | | 6/1995 | Parker | |
| 5,426,573 | A | | 6/1995 | Jenkins | |
| D360,732 | S | | 7/1995 | Parker | |
| D370,766 | S | | 6/1996 | Parker | |
| D370,767 | S | | 6/1996 | Parker | |
| D370,768 | S | | 6/1996 | Parker | |
| D385,081 | S | | 10/1997 | Parker | |
| 5,676,583 | A | | 10/1997 | Wang et al. | |
| 5,702,003 | A | | 12/1997 | Springer | |
| 5,704,103 | A | * | 1/1998 | Crowley et al. | 27/1 |
| 5,709,441 | A | | 1/1998 | Bartling et al. | |
| D390,323 | S | | 2/1998 | Parker et al. | |
| 5,794,318 | A | | 8/1998 | Parker et al. | |
| D398,132 | S | | 9/1998 | Thesken | |
| 5,799,792 | A | * | 9/1998 | Abrums | 206/508 |
| 5,815,897 | A | | 10/1998 | Longstreth | |
| D401,732 | S | | 11/1998 | Parker | |
| D401,733 | S | | 11/1998 | Thesken | |
| 5,832,575 | A | * | 11/1998 | Sturino | 27/1 |
| D403,896 | S | | 1/1999 | Bartling et al. | |
| D405,722 | S | | 2/1999 | Ayoub | |
| 5,875,528 | A | | 3/1999 | Parker | |
| 5,903,961 | A | | 5/1999 | Parker et al. | |
| D415,329 | S | | 10/1999 | Parker | |
| D418,271 | S | | 12/1999 | Parker | |
| D419,745 | S | | 1/2000 | Thesken | |
| 6,023,822 | A | | 2/2000 | Luebke | |
| D424,274 | S | | 5/2000 | Pentland | |
| D424,275 | S | | 5/2000 | Parker et al. | |
| D425,283 | S | | 5/2000 | Thesken | |
| 6,076,292 | A | | 6/2000 | Kawa | |
| 6,112,382 | A | | 9/2000 | Parker et al. | |
| D432,285 | S | | 10/2000 | Baldwin et al. | |
| D433,209 | S | | 10/2000 | Baldwin et al. | |
| D434,201 | S | | 11/2000 | Thesken | |
| 6,170,136 | B1 | | 1/2001 | Wilson-Brokl | |
| 6,175,995 | B1 | | 1/2001 | Parker et al. | |
| D439,025 | S | | 3/2001 | Brault | |
| D441,169 | S | | 4/2001 | Brault | |
| D442,347 | S | | 5/2001 | Parker | |
| 6,295,705 | B1 | * | 10/2001 | Gersten | 27/1 |
| 6,519,819 | B2 | * | 2/2003 | Suda | 27/1 |

FOREIGN PATENT DOCUMENTS

| | | | |
|---|---|---|---|
| CA | 2255252 | * | 6/2000 |
| JP | 8-112321 | * | 5/1996 |
| JP | 9-154899 | * | 6/1997 |
| JP | 10-299291 | * | 11/1998 |
| JP | 2000-5041 | * | 1/2000 |
| JP | 2001-173272 | * | 6/2001 |

* cited by examiner

*Primary Examiner*—William L. Miller
(74) *Attorney, Agent, or Firm*—Christie, Parker & Hale, LLP

(57) ABSTRACT

An urn for storing the ashes of cremated remains of a person or a pet includes a housing in the shape of a protective angel on a support having an outwardly extending shelf adjacent the angel, and on which a representation of the person or pet may rest. An outwardly opening cavity in the housing receives the cremated remains, and a cover secured over the cavity confines the cremated remains within the housing. The arms and wings of the angel are disposed to symbolize loving concern for the deceased.

14 Claims, 6 Drawing Sheets

URN FOR ASHES

FIELD OF THE INVENTION

This invention relates to urns for the cremated remains of people and pets.

BACKGROUND OF THE INVENTION

Someone who loses a loved one, such as a child, parent, or close friend, often needs to memorialize the strong emotional bond resulting from love or friendship. In a similar way, owners and pets usually have a strong emotional bond between them, and when an owner loses a pet, the owner often needs a fitting way to memorialize that loss, such as by formally burying the pet in a pet cemetery, or by suitable treatment of ashes produced by cremation of the pet remains. For example, U.S. Pat. No. 6,023,882 discloses a decorative housing in the general form of the deceased pet, and is constructed to hold pet ashes in a sealed chamber.

Although previous urns for holding ashes do memorialize a deceased person or pet, the effect is often not sufficient for those who wish to express more clearly the love and devotion that existed. This invention provides an urn which more nearly meets that need.

SUMMARY OF THE INVENTION

This invention provides an urn for storing the ashes (cremated remains) of a deceased person or a pet. The urn includes a housing in the shape of a protective angel on a support having an outwardly extending shelf adjacent the angel, and on which a representation, such as a photograph or replica of the person or pet may rest. An outwardly opening cavity in the housing receives the cremated remains, and a cover secured over the cavity confines the cremated remains within the housing.

Preferably, the face of the angel shows loving concern, and the angel leans slightly over the shelf to present a sheltering and caring mien. In another preferred form, the angel looks down at the shelf which can hold a representation or replica of the deceased person or pet, and has outstretched wings to increase the expression of care and sheltering. Moreover, an outstretched arm from the angel further connotes loving concern. Preferably the housing includes a portion with an exterior surface shaped to replicate a structure of stones to impart an aura of durability. A recess in an exterior part of the housing is shaped to receive a label with information relative to the person or pet.

Preferably, the cavity opens out of the bottom of the housing, and the cover is secured to one edge of the cavity by a hinge. In one form, a magnetic closure holds the cover in a closed position over the cavity. In another embodiment, a mechanical latch releasably secures the cover in a closed position over the cavity. A gasket is disposed between the housing and cover to seal the cavity when the cover is in the closed position. The housing adjacent the unhinged portion of the cover has a recess to permit the edge of the cover to be grasped and pulled open against the force of the magnetic closure, or to facilitate the release of the mechanical latch. In one form, the mechanical latch has a slidable bolt which can be moved between a locked and an unlocked position for the cover. Opening of the cover is also facilitated by providing a notch in the free edge of the cover adjacent the recess in the bottom of the housing. The cover and surrounding portion of the bottom of the housing present a flat, smooth surface so the urn can be easily placed in a stable position.

These and other aspects of the invention will be more fully understood from the following detailed description, taken in conjunction with the accompanying drawings.

DETAILED DESCRIPTION OF THE INVENTION

Figure 1:
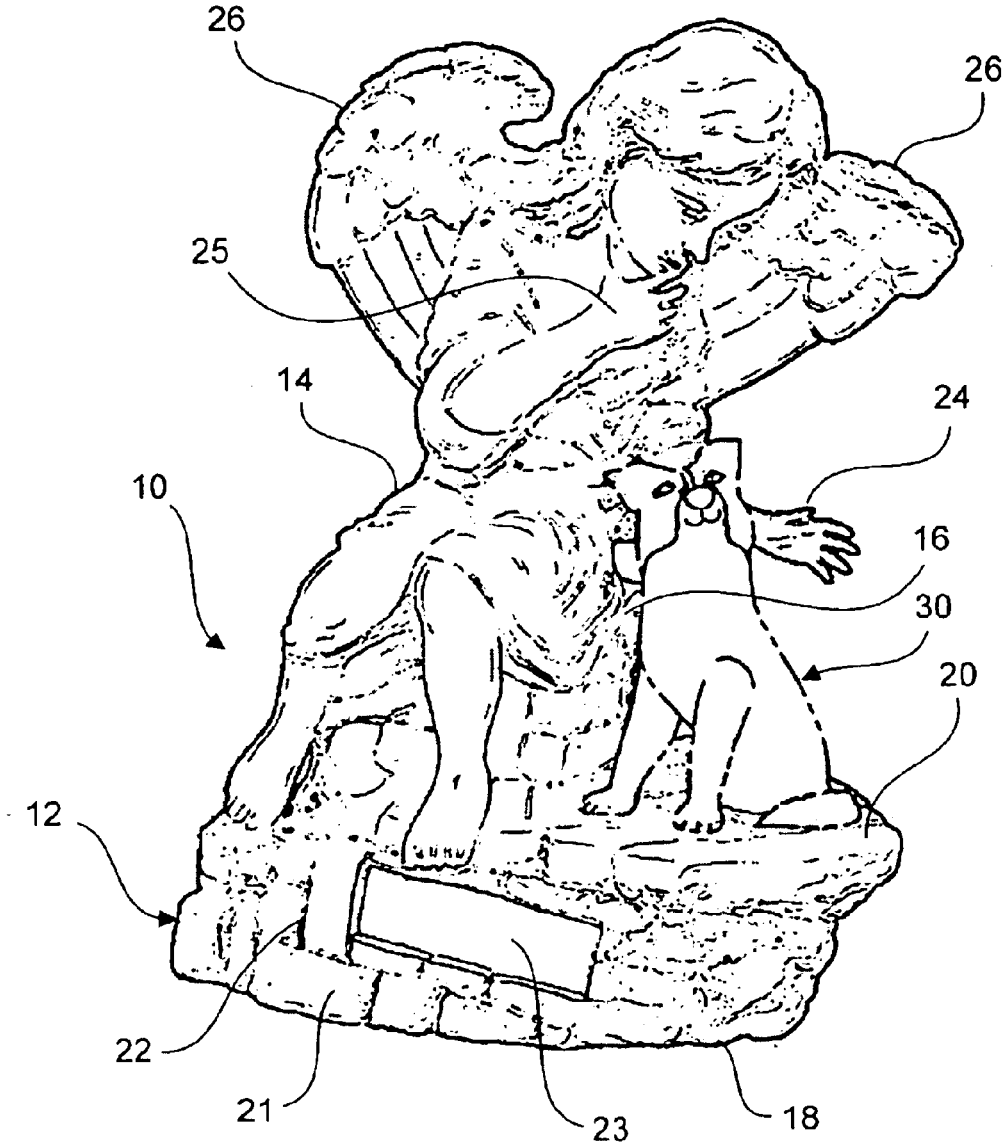
FIG. 1 is a front elevation of one embodiment of the urn.

Referring to FIG. 1, an urn 10 includes a molded housing 12 in the shape of an angel 14 sitting on a pedestal 16 formed integrally within the top of a base 18 having an outwardly extending flat shelf 20. The pedestal, base and platform are molded so the exterior surfaces of those elements resemble stones 21 set with mortar 22.

A recessed rectangular panel 23 in the front face of the base receives a label (not shown) with appropriate indicia. The recessed rectangular panel 23, which is about 3 mm deep, permits the label to be mounted so that its exterior surface does not project beyond that of the base, thus protecting the label from accidental abrasion.

In the embodiment shown in FIG. 1, the angel leans slightly over the base, and gazes in the direction of the base. The left hand and forearm 24 of the angel extend outwardly over the rear portion of the base, and the right hand 25 of the angel is adjacent the chin of the angel.

A pair of wings 26 molded integrally with the back of the angel extend outwardly on each side of the angel and open toward the platform 20, which is adapted to hold a representation on replica 30 of the deceased person or pet (shown only in phantom line). Thus, the effect of the angel sitting on the pedestal presents a protective pose and reverential contemplation of the space adapted to receive the replica of the person or pet.

Figure 2:
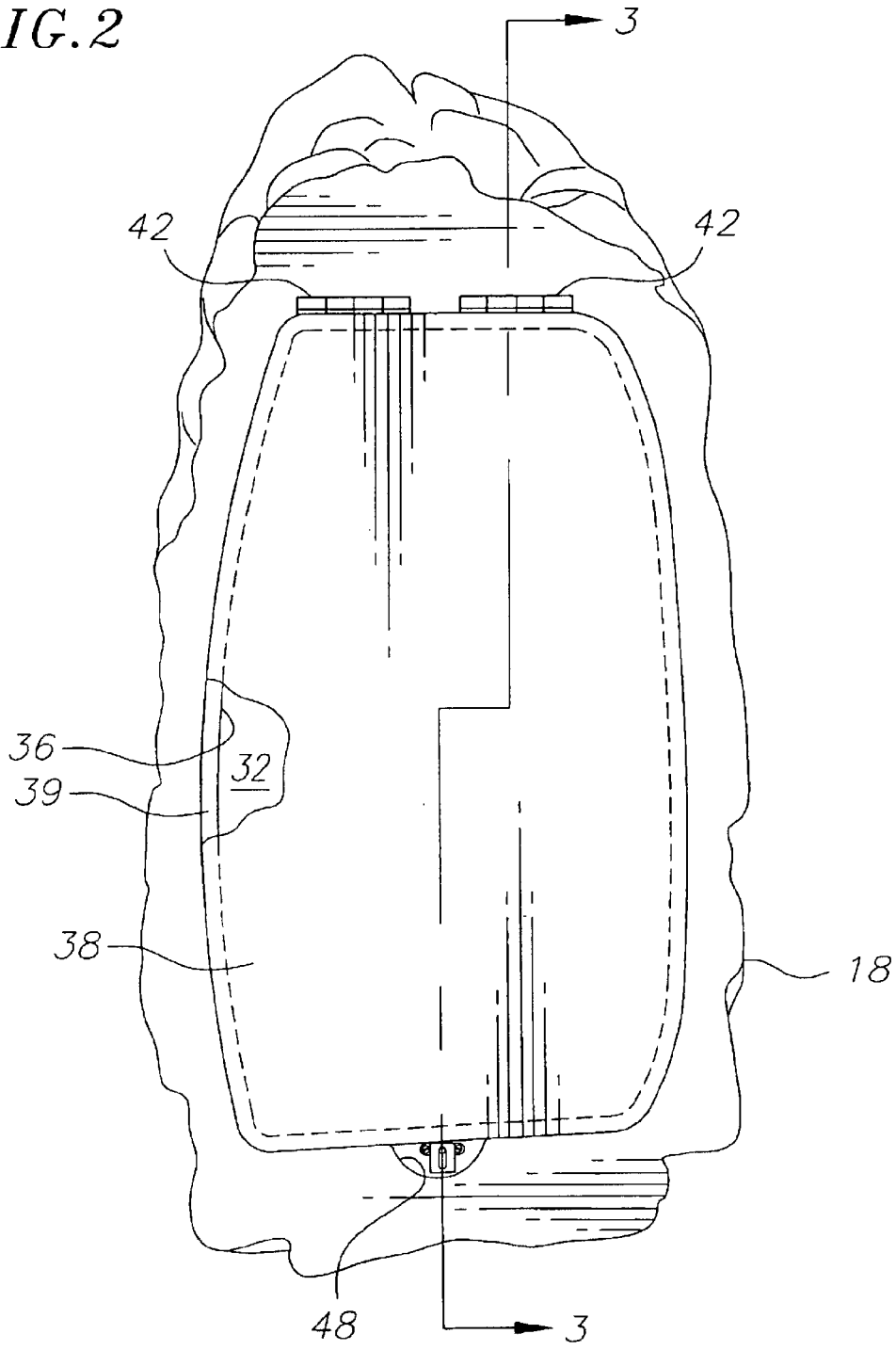
FIG. 2 is a bottom view of the urn.
Figure 3:
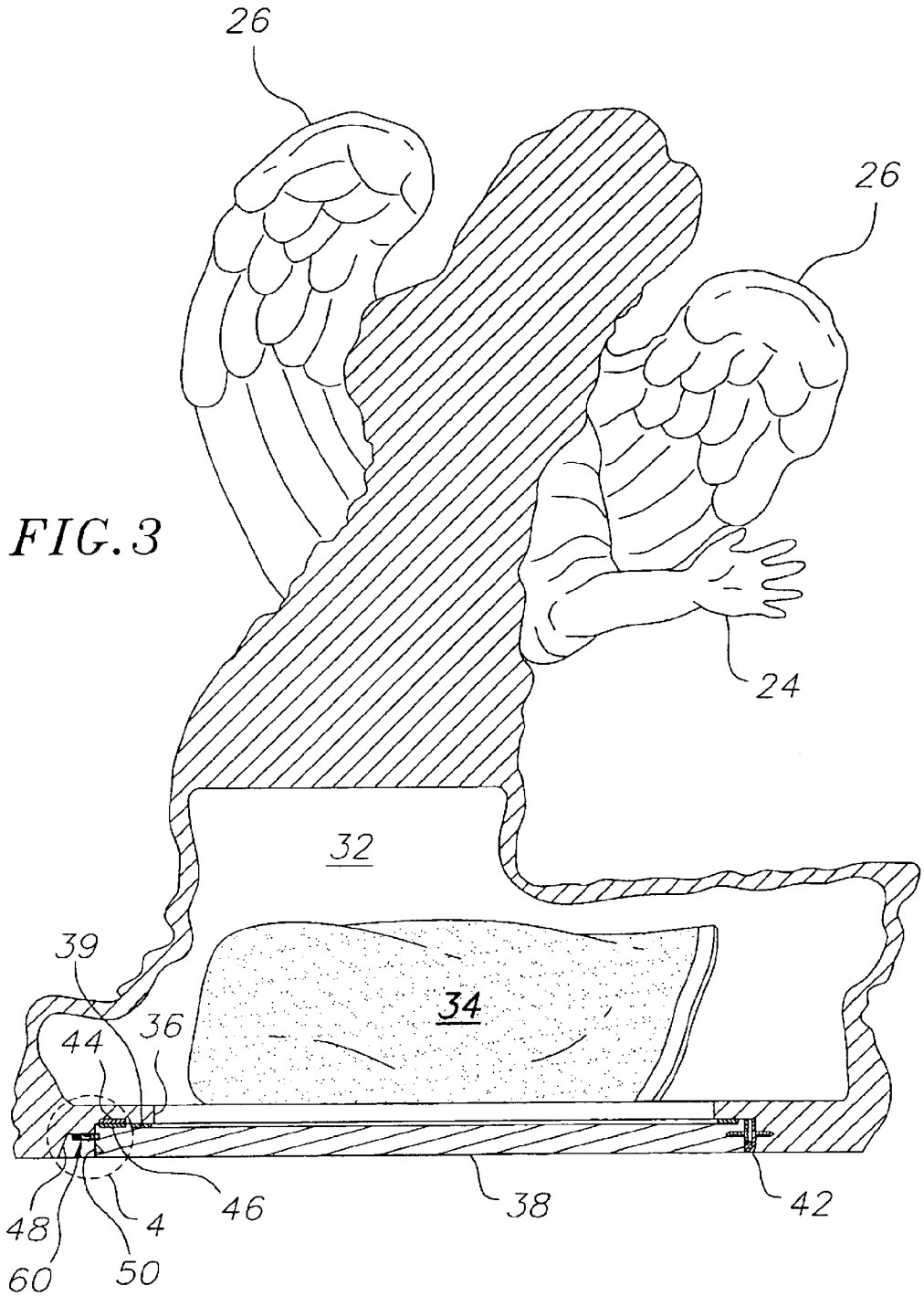
FIG. 3 is a view taken on staggered line 3—3 of FIG. 2.
Figure 4:
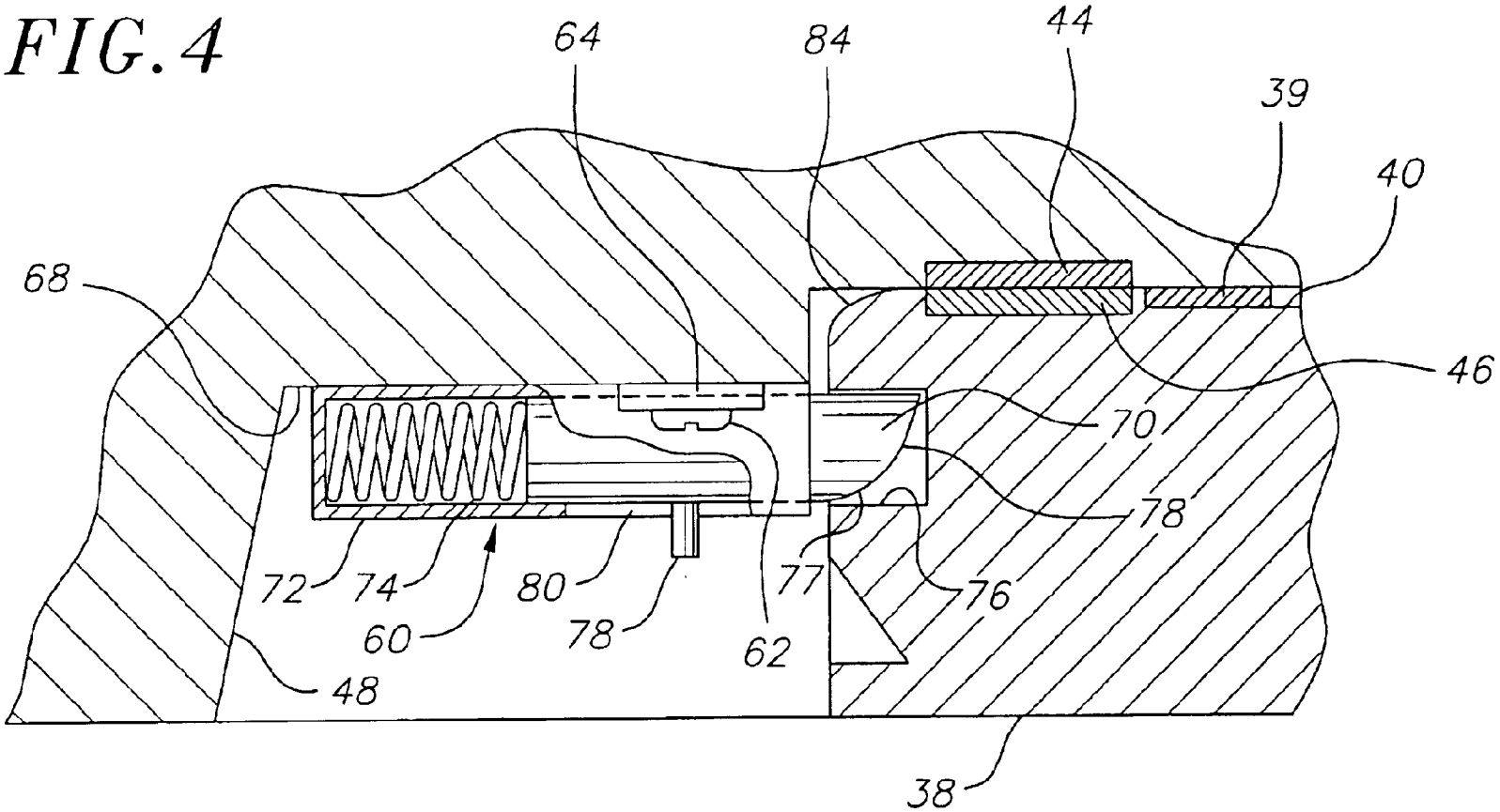
FIG. 4 is an enlarged view, partly broken away, taken in the area of the dotted circle A of FIG. 3.

As shown best in FIGS. 2 and 3, the bottom of the housing includes a downwardly opening cavity 32 adapted to hold a container 34 of ashes of the cremated remains of a deceased person or pet, or both of them. Preferably, the upper portion of the angel is solid, rather than hollow, as shown in FIG. 3, to provide greater strength for the urn. The container 34 can be any suitable device, such as a well-known Ziploc plastic bag. As shown in FIG. 2, the cavity 32 is of an elongated, generally rectangular shape, and includes an inwardly extending ledge 36 around the periphery of the opening of the cavity. A rectangular cover 38 is shaped to make a close fit within cavity 32 and rest on ledge 36. As shown in FIGS. 3 and 4, a gasket 39 in an upwardly opening recess 40 around the top surface of the cover makes a hermetic seal between the cover and the housing ledge. A pair of hinges 42 secure one end of the cover to an adjacent end of the cavity.

A first magnet 44 embedded in the shelf 36 at the end of the cavity remote from the hinges mates with a second magnet 46 embedded in the upper surface of the end of the cover remote from the hinges, and holds the cover in the closed position shown in FIG. 3.

A downwardly opening indentation 48 in the lower surface of the urn housing, and adjacent the free end of the cover, facilitates opening the cover against the force of the magnets. Opening the cover is further facilitated by an outwardly opening notch 50 in the free edge of the cover remote from the hinges. The indentation 48 is sufficiently large to permit one to insert a finger into that space, and engage notch 50 so that the cover can be pulled and pivoted about the hinges in a counterclockwise direction (as viewed in FIG. 3) to open the bottom of the urn so that the container with the ashes of the cremated remains of a person or pet can be inserted into the cavity 32. Preferably, the cavity is sufficiently large to hold both the cremated remains of a pet and the owner of the pet. Thereafter the cover is moved to the closed position in FIG. 3, and held in that position by the magnets. More than one set of magnets can be used at the interface between the ledge 36 and cover 38 to provide additional force for holding the cover in the closed position.

If the weight of the cremated remains stored in the cavity is too large to be reliably held by magnets, a mechanical latch 60 (FIGS. 3 and 4) is secured by screws 62 through ears 64 on opposite sides of the latch to hold the latch against the upper surface 68 of the indentation 48. The latch includes a slidable bolt 70 in a latch cylinder 72. A compression spring 74 in the cylinder urges the latch to slide to the right (as viewed in FIG. 4) so the right end of the bolt fits snugly in a cylindrical bore 76 in the free edge of the cover. A downwardly extending pin 78 is threaded at its upper end into the lower portion of the bolt, and is adapted to travel in a longitudinal slot 80 in the cylinder, so the pin 78 can be moved to the left (as viewed in FIG. 4) to withdraw the bolt from bore 76, and permit the cover to be pulled away from the cavity. The right (as viewed in FIG. 3) end of the bolt is curved to present a downwardly facing convex section 77, which merges with an upwardly and outwardly sloping segment 78, to engage a upwardly convex curved surface 84 at the upper edge of the free end of the cover so that closing and locking the cover in the closed position shown in FIG. 3 is easily done by pivoting the cover about the hinges in a clockwise direction (as viewed in FIG. 4) so that the curved surface 84 on the cover engages the convex section 77 and the sloping segment 78 on the right end of the bolt to force the bolt to the left so the cover can move to the closed position shown in FIG. 3. Compression spring 74 snaps the bolt into the bore 76 so the cover is locked in the closed position.

The urn 10 can be made of any suitable material used for casting statues. However, I presently prefer to use unsaturated polyester resin pottery plaster, which simulates the appearance of marble. Any suitable pigment can be mixed with the casting material to give the urn any desired color.

Figure 5:
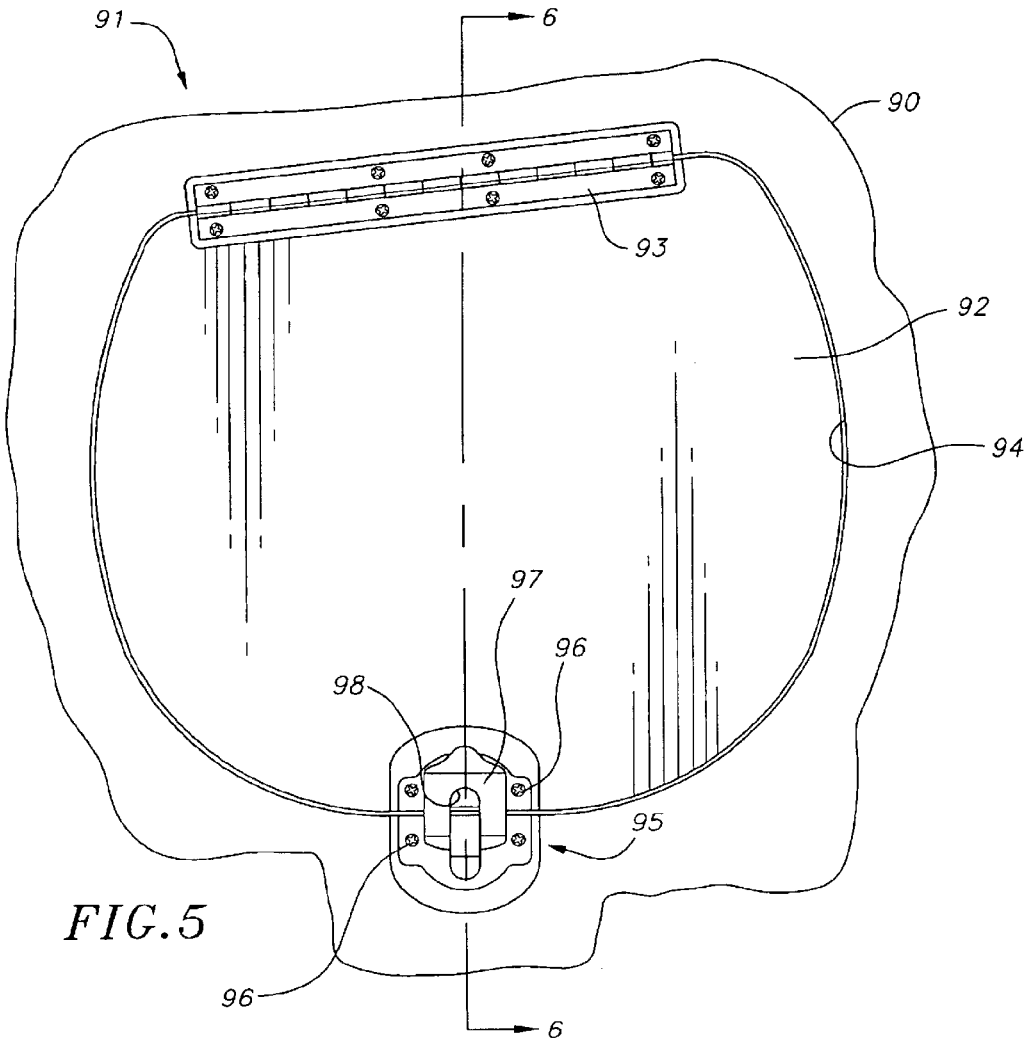
FIG. 5 is a fragmentary view of the bottom of the urn showing an alternate latch for the cover.
Figure 6:
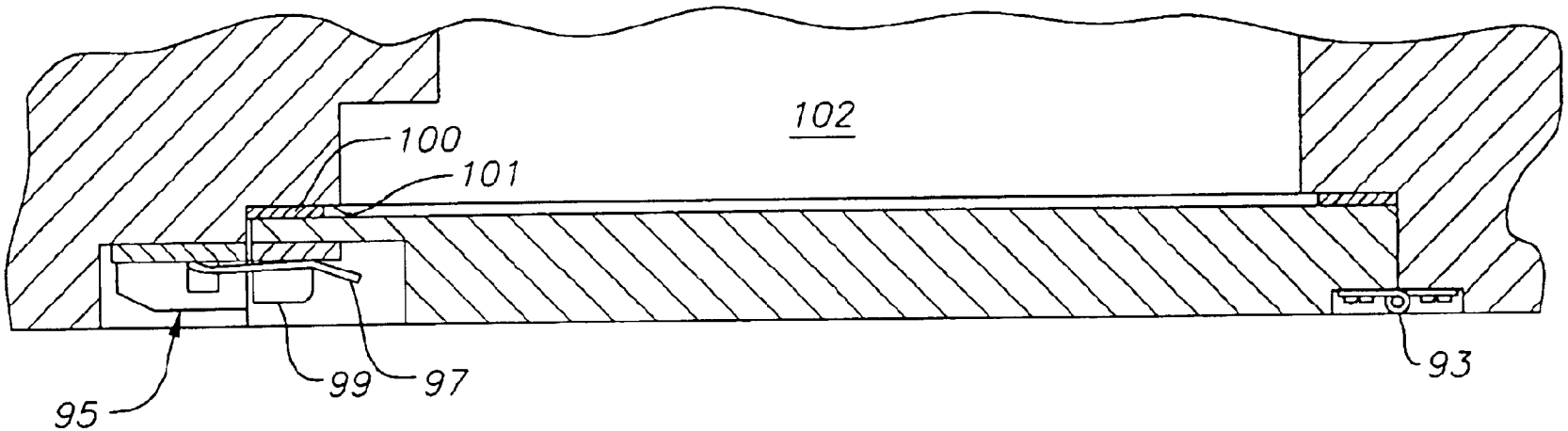
FIG. 6 is a view taken on line 6—6 of FIG. 5.

Referring to FIGS. 5 and 6, which show the bottom of a base 90 of an alternate urn 91 of this invention, a cover 92 is secured at one edge by a hinge 93 to the bottom of the base to make a snug fit over an opening 94 in the base. A conventional two-piece latch 95 is secured by screws 96 to the base and cover. The piece of the latch secured to the base includes an elongated tongue 97 with a central opening 98, which makes a snug fit over a downwardly extending latch post 99 on the piece of the latch secured to the lid. The upper surface of the perimeter of the lid (FIG. 6) makes a snug fit against a gasket 100 on a downwardly facing ledge 101 around a cavity 102 opening out of the bottom of the base. The gasket extends around the perimeter of the lid to seal the cavity from the elements. To release the cover from the closed position shown in FIG. 1, the tongue 97 is pulled downwardly (as viewed in FIG. 6) so the tongue pivots in a clockwise direction about the anchor piece secured to the base. Once the tongue clears the retaining pin 99, the lid is free to swing to the open position. The lid is moved into and secured in the closed position by reversing the opening procedure just described.

What is claimed is:

1. An urn for storing cremated remains of a person or a pet, the urn comprising:

a housing in the shape of a protective angel on a pedestal with an outwardly extending shelf adjacent the angel, and on which a representation of the person or pet may rest; the angel being disposed to lean over the shelf and form a sheltered space over the shelf wherein the space is adapted to receive the representation of the person or pet;

an outwardly opening cavity in the housing for receiving the cremated remains; and a cover secured over the cavity to secure the cremated remains within the housing.

2. An urn according to claim 1 in which the angel is looking down at the shelf.

3. An urn according to claim 1 or 2 in which the angel includes outstretched wings opening toward the shelf.

4. An urn according to claim 1 or 2 in which the angel includes an arm extending out over the shelf.

5. An urn according to claim 1 or 2 in which the housing includes a base having external grooves to give the base the appearance of being made of stones.

6. An urn according to claim 1 or 2 which includes a recessed panel in part of the housing to receive a label with information relative to the person or pet.

7. An urn according to claim 1 or 2 which includes the cover secured to the bottom of the housing to be moveable between an open position and a closed position where the cover fits over the cavity in the housing.

8. An urn according to claim 7 in which the cover in the closed position makes a smooth, flat surface with the bottom of the housing.

9. An urn according to claim 7 includes magnetic closure for holding the cover in the closed position.

10. An urn according to claim 7 which includes a releasable mechanical latch for locking the cover in the closed position.

11. An urn according to claim 10 in which a free edge of the cover includes an outwardly opening notch to facilitate pulling the cover from the closed to the open position.

12. An urn according to claim 7 in which the housing includes an indentation adjacent a free edge of the cover to facilitate pulling the cover from the open position.

13. An urn according to claim 7 which includes a gasket disposed to seal the cavity when the cover is in the closed position.

14. An urn according to claim 7 in which a hinge secures the cover to the bottom of the housing.

* * * * *